US009175855B2

(12) United States Patent
Wegerif et al.

(10) Patent No.: US 9,175,855 B2
(45) Date of Patent: Nov. 3, 2015

(54) COMBUSTION NOZZLE WITH FLOATING AFT PLATE

(71) Applicant: General Electric Company, Schenectady, NY (US)

(72) Inventors: Daniel Gerritt Wegerif, Greenville, SC (US); Jonathan Dwight Berry, Greenville, SC (US); Carl Robert Barker, Greenville, SC (US)

(73) Assignee: General Electric Company, Schenectady, NY (US)

( * ) Notice: Subject to any disclaimer, the term of this patent is extended or adjusted under 35 U.S.C. 154(b) by 368 days.

(21) Appl. No.: 13/662,621

(22) Filed: Oct. 29, 2012

(65) Prior Publication Data

US 2014/0338349 A1 Nov. 20, 2014

(51) Int. Cl.
*F23R 3/04* (2006.01)
*F23R 3/28* (2006.01)

(52) U.S. Cl.
CPC . *F23R 3/04* (2013.01); *F23R 3/283* (2013.01); *F23R 3/286* (2013.01); *F23R 2900/03044* (2013.01)

(58) Field of Classification Search
CPC ..... F23R 3/286; F23R 3/283; F23R 2900/03044; F23D 14/70
USPC ..... 60/737, 740, 742, 800; 431/2, 253, 186
See application file for complete search history.

(56) References Cited

U.S. PATENT DOCUMENTS

| | | | | |
|---|---|---|---|---|
| 3,662,578 | A | 5/1972 | Gleason et al. | |
| 4,102,027 | A | 7/1978 | Greever et al. | |
| 4,216,826 | A | 8/1980 | Fujikake | |
| 4,313,248 | A | 2/1982 | Fujikake | |
| 4,426,868 | A | 1/1984 | Torniainen | |
| 5,274,991 | A * | 1/1994 | Fitts | 60/800 |
| 5,357,745 | A | 10/1994 | Probert | |
| 6,053,209 | A | 4/2000 | Wagner et al. | |
| 6,166,348 | A | 12/2000 | Brundermann | |
| 6,339,923 | B1 * | 1/2002 | Halila et al. | 60/798 |
| 6,453,675 | B1 * | 9/2002 | Royle | 60/800 |
| 6,910,336 | B2 | 6/2005 | Sullivan et al. | |
| 8,707,672 | B2 * | 4/2014 | Zuo et al. | 60/39.37 |
| 8,756,934 | B2 * | 6/2014 | Melton et al. | 60/737 |
| 2009/0188255 | A1 * | 7/2009 | Green et al. | 60/737 |
| 2009/0242184 | A1 | 10/2009 | Mishima et al. | |
| 2011/0113783 | A1 * | 5/2011 | Boardman et al. | 60/723 |
| 2011/0314823 | A1 * | 12/2011 | Smith et al. | 60/737 |
| 2012/0006030 | A1 | 1/2012 | Uhm et al. | |
| 2012/0036856 | A1 | 2/2012 | Uhm et al. | |
| 2012/0058437 | A1 | 3/2012 | Uhm et al. | |

OTHER PUBLICATIONS

U.S. Appl. No. 13/423,894, filed Mar. 19, 2012, Westmoreland, et al.
U.S. Appl. No. 13/423,854, filed Mar. 19, 2012, Johnson, et al.
U.S. Appl. No. 13/425,950, filed Mar. 21, 2012, Melton et al.

* cited by examiner

*Primary Examiner* — Phutthiwat Wongwian
*Assistant Examiner* — Thomas Burke
(74) *Attorney, Agent, or Firm* — Sutherland Asbill & Brennan LLP

(57) ABSTRACT

The present application provides a combustion nozzle for use with a gas turbine engine. The combustion nozzle may include a number of mixing tubes, an outer shell surrounding the mixing tubes, and a floating aft plate assembly. The floating plate assembly may enclose the outer shell. The mixing tubes may extend through the aft plate assembly.

8 Claims, 4 Drawing Sheets

COMBUSTION NOZZLE WITH FLOATING AFT PLATE

TECHNICAL FIELD

The present application and the resultant patent relate generally to gas turbine engines and more particularly relate to a combustion nozzle with a floating aft plate so as to accommodate temperature differentials.

BACKGROUND OF THE INVENTION

Operational efficiency and overall output of a gas turbine engine generally increases as the temperature of the hot combustion gas stream increases. High combustion gas stream temperatures, however, may produce high levels of nitrogen oxides and other types of regulated emissions. A balancing act thus exists between operating a gas turbine engine in an efficient temperature range while also ensuring that the output of nitrogen oxides and other types of regulated emissions remain below mandated levels.

Lower emission levels of nitrogen oxides and the like may be promoted by providing for good mixing of the fuel stream and the air stream before combustion. Such premixing tends to reduce combustion temperatures and the output of nitrogen oxides. One method of providing such good mixing is through the use of micro-mixers where the fuel and air are mixed in a number of micro-mixing tubes within a plenum before combustion.

During operation, however, temperature differences may arise between the various components of a micro-mixing nozzle. For example, the interior components of the nozzle may be at about the compressor discharge temperature while exterior components, such as an aft plate, may reach the higher temperatures of the combustion products. This temperature differential may cause the aft plate to expand relative to the nozzle. Given that the aft plate may be fixedly attached to the nozzle, such growth may result in excessive strain. Such strain may significantly affect the life of the aft plate and nozzle as a whole.

There is thus a desire for an improved micro-mixer nozzle design. Such an improved micro-mixer nozzle design may promote good fuel-air mixing while accommodating temperature differentials across the aft plate and other components therein.

SUMMARY OF THE INVENTION

The present application and the resultant patent thus provide a combustion nozzle for use with a gas turbine engine and the like. The combustion nozzle may include a number of mixing tubes, an outer shell surrounding the mixing tubes, and a floating aft plate assembly. The floating plate assembly may enclose the outer shell. The mixing tubes may extend through the aft plate assembly.

The present application and the resultant patent further provide a method of operating a combustion nozzle enclosed by an aft plate. The method may include the steps of mixing a flow of fuel and a flow of air in a number of tubes in the combustion nozzle at a first temperature, combusting the mixed flow of fuel and air downstream of the aft plate at a second temperature, and allowing the aft plate to float within the combustion nozzle as the aft plate approaches the second temperature.

The present application and the resultant patent further provide a combustion nozzle for use with a gas turbine engine. The combustion nozzle may include a number of mixing tubes, an outer shell surrounding the mixing tubes, an impingement plate attached to the outer shell, and an aft plate pinned to the impingement plate.

These and other advantages and improvements of the present application and the resultant patent will become apparent to one of ordinary skill in the art upon review of the following detailed description when taken in conjunction with the several drawings and the appended claims.

DETAILED DESCRIPTION

Figure 1:
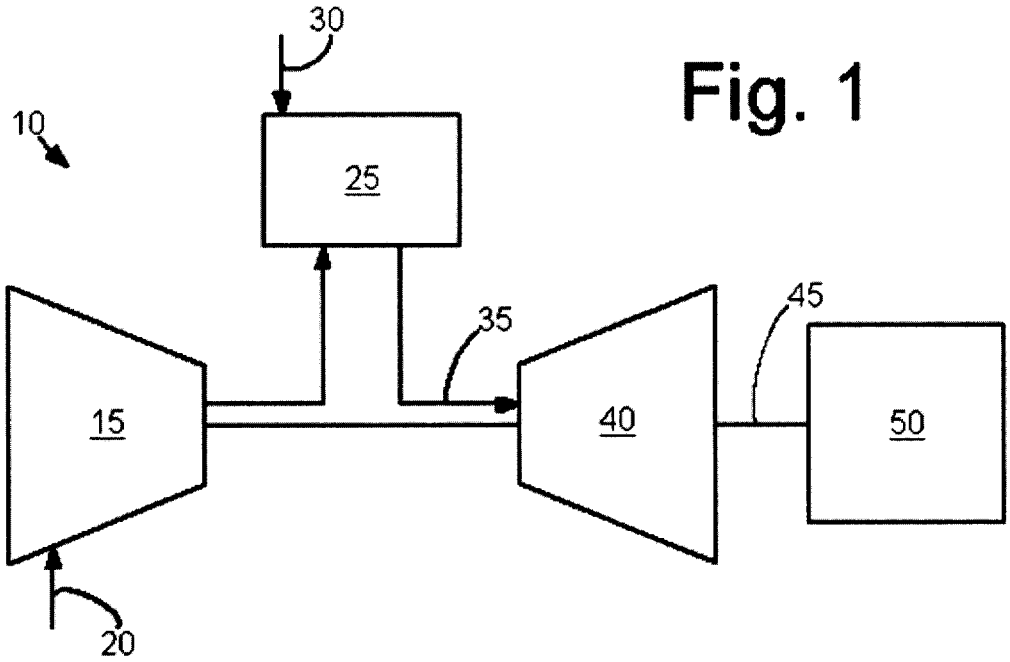
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of the combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
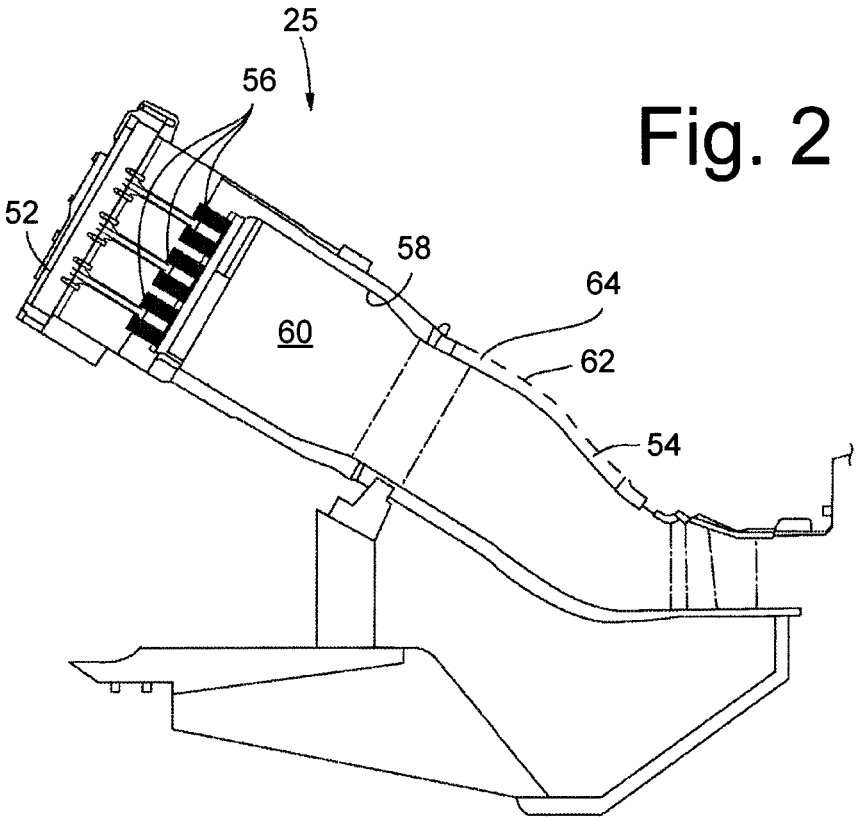
FIG. 2 is a schematic diagram of a combustor as may be used with the gas turbine engine of FIG. 1.

FIG. 2 shows a schematic diagram of an example of the combustor 25 as may be used with the gas turbine engine 10 described above. The combustor 25 may extend from an end cap 52 at a head end to a transition piece 54 at an aft end about the turbine 40. A number of fuel nozzles 56 may be positioned about the end cap 52. A liner 58 may extend from the fuel nozzles 56 towards the transition piece 54 and may define a combustion zone 60 therein. The liner 58 may be surrounded by a flow sleeve 62. The liner 58 and the flow sleeve 62 may define a flow path 64 therebetween for the flow of air 20 from the compressor 15 or otherwise. The combustor 25 described herein is for the purpose of example only. Combustors with other components and other configurations may be used herein.

Figure 3:
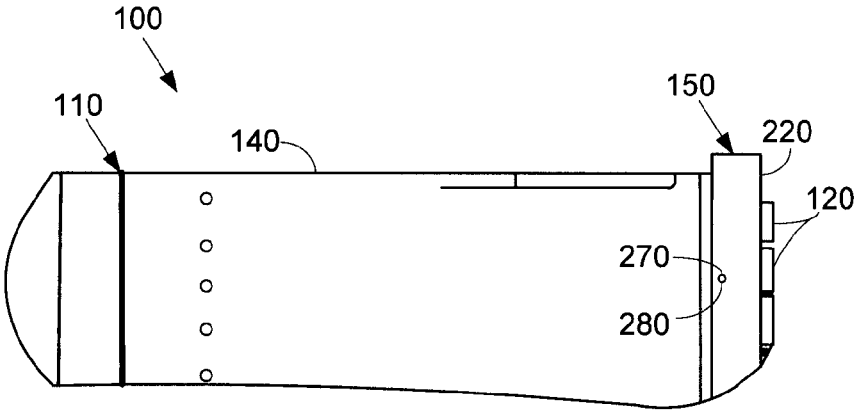
FIG. 3 is a partial plan view of a micro-mixing nozzle as may be described herein.
Figure 4:
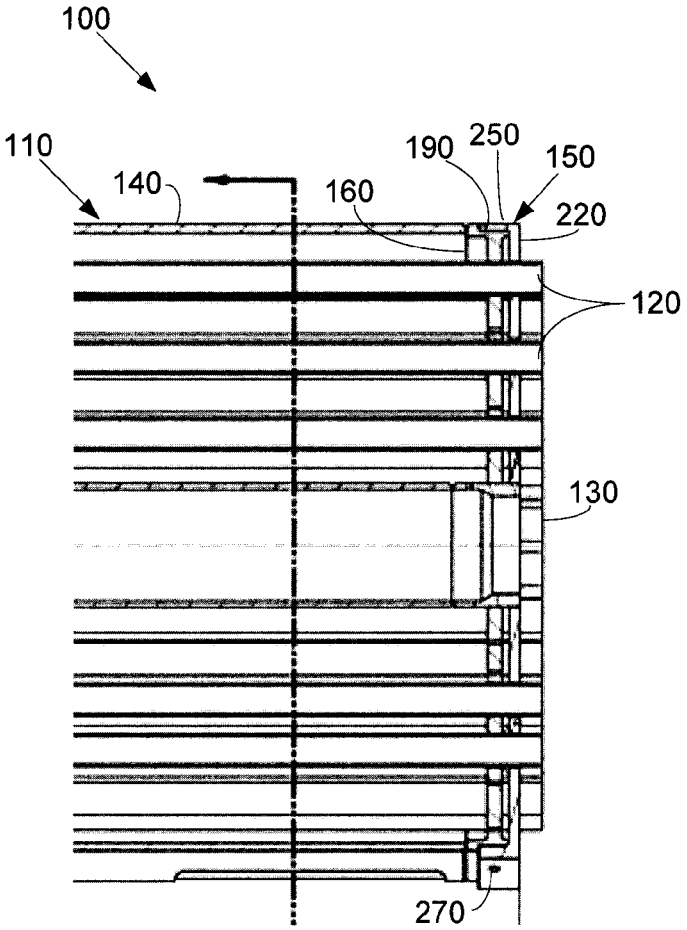
FIG. 4 is a side cross-sectional view of a portion of the micro-mixing nozzle of FIG. 3.

FIG. 3 and FIG. 4 show portions of a combustion nozzle 100 as may be described herein. The combustion nozzle 100 may be a micro-mixing nozzle 110. The combustion nozzle 100 may be used with the combustor 25 as is described above. The combustion nozzle 100 may include a number of mixing tubes 120 positioned about a central fuel tube 130. Any number of the mixing tubes 120 may be used. The mixing tubes 120 may be in communication with the flow of air 20 and the flow of fuel 30 for mixing therein. The mixing tubes 120 and the central fuel tube 130 may have any size, shape, or configuration. The mixing tubes 120 and the central fuel tube 130 may be positioned within an outer shell 140. In this example, the outer shell 140 may have a wedge-like shape. The outer shell 140 may have any size, shape, or configuration. Other components and other configurations may be used herein.

Figure 5:
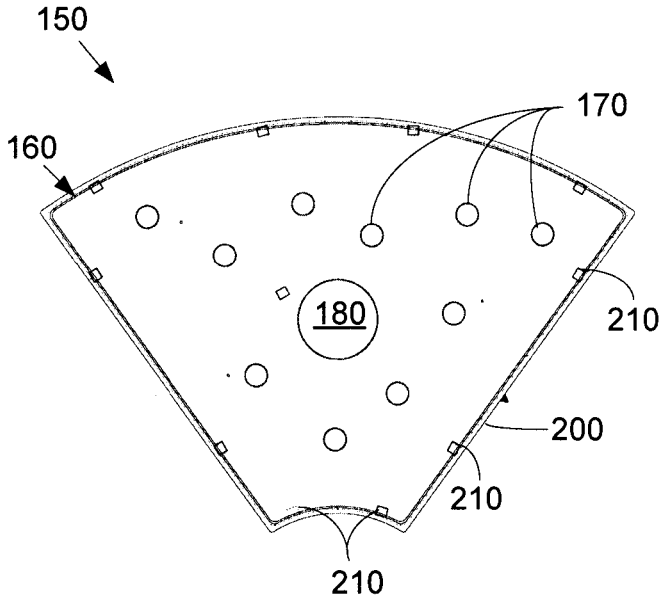
FIG. 5 is a plan view of an impingement plate as may be used in the micro-mixing nozzle of FIG. 3.
Figure 6:
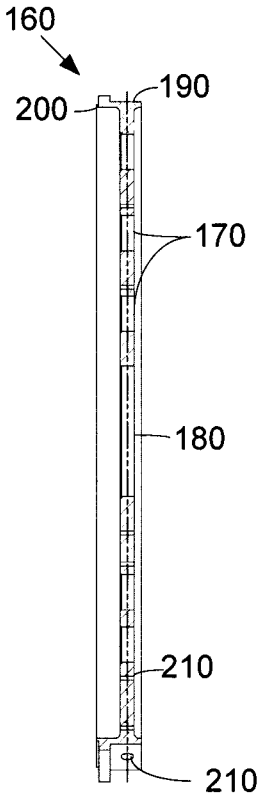
FIG. 6 is a side cross-sectional view of the impingement plate of FIG. 5.
Figure 7:
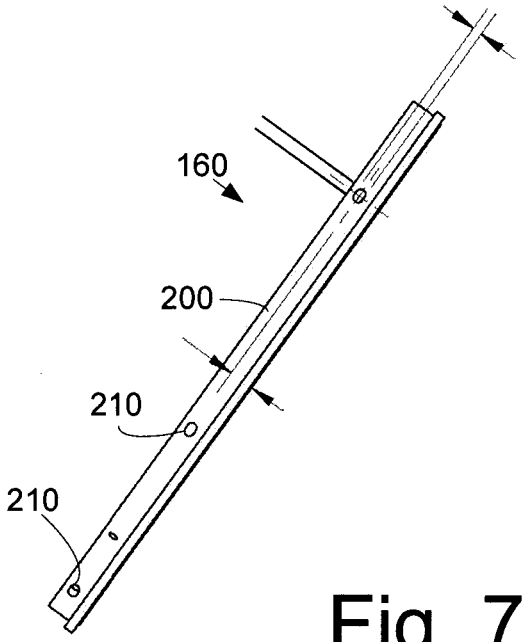
FIG. 7 is a side plan view of the impingement plate of FIG. 5.

The nozzle 100 and the outer shell 140 may be enclosed by a floating aft plate assembly 150. The floating aft plate assembly 150 may include an impingement plate 160. The impingement plate 160 may be welded or otherwise attached to the outer shell 140. As is shown in FIGS. 5-7, the impingement plate 160 may largely conform to the size and shape of the outer shell 140. The impingement plate 160 may include a number of impingement plate mixing tube holes 170 and an impingement plate central fuel tube hole 180. The impingement plate mixing tube holes 170 and the impingement plate central fuel tube hole 180 may be sized to accommodate the mixing tubes 120 and the central fuel tube 130 extending therethrough.

The impingement plate 160 may have an indent 190 positioned about an impingement plate periphery 200 thereof. The size, shape, and configuration of the indent 190 may vary. A number of impingement plate slotted holes 210 may be extending through the indent 190 about the impingement plate periphery 200. The size, shape, and configuration of the impingement plate slotted holes 210 may vary. Although ten (10) impingement plate slotted holes 210 are shown herein, any number of the slotted holes 210 may be used. The impingement plate slotted holes 210 may be substantially equally spaced about the impingement plate periphery 200. Other components and other configurations may be used herein.

Figure 8:
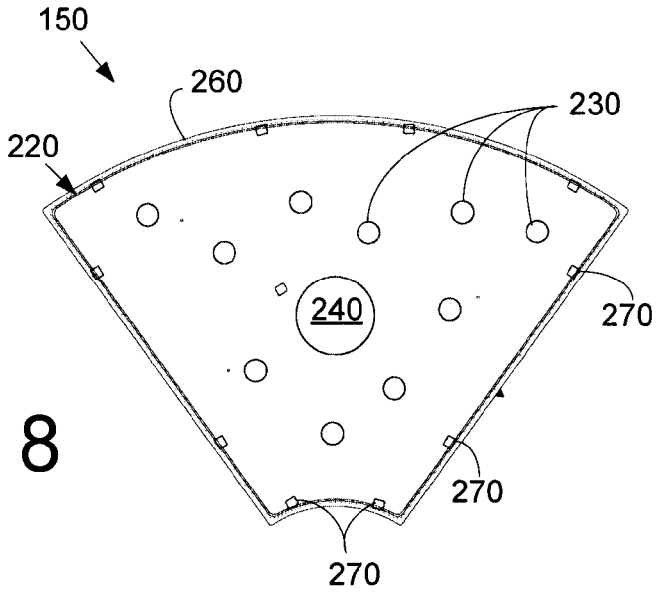
FIG. 8 is a front plan view of an aft plate as may be used in the micro-mixing nozzle of FIG. 3.
Figure 9:
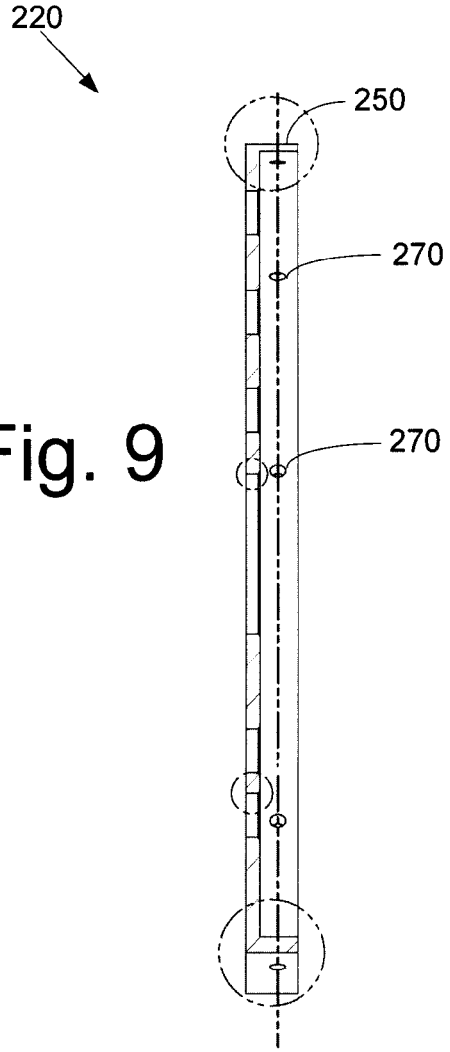
FIG. 9 is a side cross-sectional view of the aft plate of FIG. 8.
Figure 10:
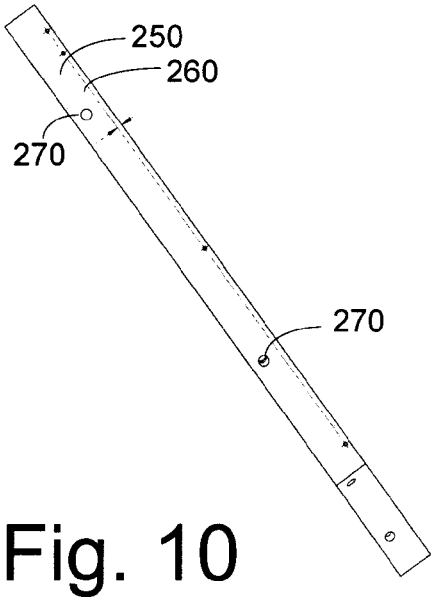
FIG. 10 is a side plan view of the aft plate of FIG. 8.

The floating aft plate assembly 150 also may include an aft plate 220. As is shown in FIGS. 8-10, the aft plate 220 may have be sized and shaped so as to be positioned about the indent 190 of the impingement plate 160. The aft plate 220 may be welded or otherwise attached to the center fuel tube 130. The aft plate 220 may include a number of aft plate mixing tube holes 230 and an aft plate central fuel tube hole 240. The aft plate mixing tube holes 230 and the aft plate central fuel tube hole 240 may be sized to accommodate the mixing tubes 120 and the central fuel tube 130 extending therethrough.

The aft plate 220 may include a flange 250 extending about an aft plate periphery 260. The flange 250 may be sized to accommodate the indent 190 of the impingement plate 160. Once positioned about the indent 190, the flange 250 may be largely flush with the outer shell 140 or extend somewhat beyond. The flange 250 may have a number of aft plate slotted holes 270. The size, shape, and configuration of the aft plate slotted holes 270 may vary. Although ten (10) of the aft plate slotted holes 270 are shown, the aft plate 220 may have any number herein. The aft plate slotted holes 270 may be substantially equally spaced about the aft plate periphery 260 and align with the impingement plate slotted holes 210. Other components and other configurations may be used herein.

The floating aft plate assembly 150 also may include a number of pins 280. In this example, ten (10) pins 280 are shown for each of the impingement plate slotted holes 210 and the aft plate slotted holes 270, although any number of the pins 280 may be used herein. The size, shape and configuration of the pins 280 may vary. The pins 280 may be welded to the aft plate 220 or the impingement plate 160 or otherwise attached. Other components and other configurations may be used herein.

In use, the floating aft plate assembly 150 may enclose the outer shell 140 of the nozzle 100. In this example, the impingement plate 160 may be welded or otherwise attached to the outer shell 140. The aft plate 220 may be positioned about the indent 190 of the impingement plate periphery 200 and secured therein via the pins 280. Instead of rigidly attaching the aft plate 220 to the outer shell 140, the aft plate 220 is pined about the aft plate perimeter 260 so as to allow the aft plate 220 to "float" about the impingement plate 160 and the outer shell 140 and thus accommodate thermal growth therein.

Specifically, the pins 280 may be positioned within the slotted holes 210, 270 so as to allow for circumferential growth. The pins 280 may transfer axial loads generated by the combustion gases 35 into the nozzle 100 itself. By allowing the aft plate 220 to float about the pins 280, thermally induced strain may be reduced so as to provide for good component lifetime. Moreover, different and more cost effective materials also may be used herein because the aft plate 220 is not welded or otherwise fixedly attached to the outer shell 140 of the nozzle 100.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A combustion nozzle for use with a gas turbine engine, comprising:

a plurality of mixing tubes;

an outer shell surrounding the plurality of mixing tubes; and a floating aft plate assembly, comprising:

an impingement plate attached to the outer shell, wherein the impingement plate comprises an indent about an impingement plate periphery and a plurality of impingement plate slotted holes extending through the indent;

an aft plate comprising a flange about an aft plate periphery, wherein the flange is configured to mate with the indent and comprises a plurality of aft plate slotted holes extending through the flange; and a plurality of pins positioned within the plurality of impingement plate slotted holes and the plurality of aft plate slotted holes to secure the impingement plate to the aft plate;

wherein the floating aft plate assembly enclosing the outer shell; and wherein the plurality of mixing tubes extending through the floating aft plate assembly.

2. The combustion nozzle of claim 1, wherein the impingement plate is welded to the outer shell.

3. The combustion nozzle of claim 1, wherein the impingement plate comprises a plurality of impingement plate mixing tube holes.

4. The combustion nozzle of claim 1, further comprising a central fuel tube and wherein the aft plate is welded to the central fuel tube.

5. The combustion nozzle of claim 1, wherein the aft plate comprises a plurality of aft plate mixing tube holes.

6. A method of operating a combustion nozzle enclosed by an aft plate, comprising:

mixing a flow of fuel and a flow of air in a plurality of tubes in the combustion nozzle at a first temperature;

combusting the mixed flow of fuel and air downstream of the aft plate at a second temperature, wherein the aft plate comprises a flange about an aft plate periphery, wherein the flange comprises a plurality of aft late slotted holes extending therethrough and is configured to mate with an indent in an impingement plate; and allowing the aft plate to float within the combustion nozzle as the aft plate approaches the second temperature by attaching the aft plate to the impingement plate by way of a plurality of pins positioned within a plurality of impingement plate slotted holes in the indent and the plurality of aft plate slotted holes in the flange to secure the impingement plate to the aft plate.

7. A combustion nozzle for use with a gas turbine engine, comprising:

a plurality of mixing tubes;

an outer shell surrounding the plurality of mixing tubes;

an impingement plate attached to the outer shell, wherein the impingement plate comprises an indent about an impingement plate periphery and a plurality of impingement plate slotted holes extending through the indent;

an aft plate comprising a flange about an aft plate periphery, wherein the flange is configured to mate with the indent and comprises a plurality of aft plate slotted holes extending through the flange; and a plurality of pins positioned within the plurality of impingement plate slotted holes and the plurality of aft plate slotted holes to secure the impingement plate to the aft plate.

8. The combustion nozzle of claim 7, wherein the combustion nozzle comprises a micro-mixing nozzle.

* * * * *